United States Patent [19]

McCullough, Jr. et al.

[11] Patent Number: 4,902,561

[45] Date of Patent: Feb. 20, 1990

[54] LOCK SET STRUCTURE

[75] Inventors: Francis P. McCullough, Jr., Lake Jackson; R. Vernon Snelgrove, Damon, both of Tex.; Bhuvenesh C. Goswami, Clemson, S.C.

[73] Assignee: The Dow Chemical Company, Midland, Mich.

[21] Appl. No.: 344,327

[22] Filed: Apr. 27, 1989

Related U.S. Application Data

[63] Continuation-in-part of Ser. No. 163,923, Mar. 4, 1988, abandoned.

[51] Int. Cl.[4] ..... D04H 1/08

[52] U.S. Cl. ..... 428/280; 428/218; 428/284; 428/288; 428/296; 428/297; 428/298; 428/300; 428/408

[58] Field of Search ..... 428/218, 280, 288, 296, 428/284, 297, 298, 300, 408

[56] References Cited

U.S. PATENT DOCUMENTS

| | | | |
|---|---|---|---|
| 4,284,680 | 8/1981 | Awano et al. | 428/234 |
| 4,412,675 | 11/1983 | Havakubo | 267/167 |
| 4,631,118 | 12/1986 | McCullough et al. | 204/16 |
| 4,643,931 | 2/1987 | McCullough et al. | 428/97 |

*Primary Examiner*—James J. Bell

[57] ABSTRACT

A process for producing an interlocked fibrous structure useful as a thermal insulating and/or sound absorbing structure comprising at least one batting of non-flammable carbonaceous fibers, by the steps comprising implanting said batting with non-carbonaceous polymeric fibers and then heat treating the structure in an inert atmosphere so as to transform said non-carbonaceous fibers into substantially permanently set carbonaceous fibers.

5 Claims, 2 Drawing Sheets

LOCK SET STRUCTURE

RELATED APPLICATION

This application is a continuation in part of application Ser. No. 163,923, filed Mar. 4, 1988, of McCullough et al now abandoned.

FIELD OF THE INVENTION

The present invention relates to a process for densifying or joining together a batting or battings of non-flammable heat set carbonaceous polymeric fibers by locking together the batting fibers with fibers of similar chemical composition to the precursor fibers of the carbonaceous polymeric fibers and then heat treating the entire structure to substantially permanently heat set the interlocking fibers. The densified structure of the present invention has utility in applications where the structure is exposed to high temperatures such as in high temperature themal/sound insulation applications and high temperature filtration. The structures comprising non-linear fibers prepared by the process of the invention are characterized by having good shape and volume retention and are stable to numerous compression and unloading cycles. Those structures comprising non-linear fibers are characterized by having a high densification, a felt-like appearance and few broken fibers.

BACKGROUND OF THE INVENTION

For many high temperature applications, such as high temperature insulation, it is desirable to have a densified felt, blanket or batting structure which will retain its integrity and its dense structure at prolonged exposure to high temperatures. Structures are desirable which can be used at temperatures greater than 400 degrees C. and which will maintain their good mechanical and physical characteristics.

Elongatable carbonaceous fibers described in copending U.S. patent application Ser. No. 112,353 of McCullough et al, which is herewith incorporated by reference, and the insulation material described in copending U.S. patent application Ser. No. 108,255 of McCullough et al, offer good base materials for high temperatures applications. However, it has not been possible, prior to the present invention described hereinafter, to permanently densify the batting structures described in the above patent applications and maintain their integrity at high temperatures.

For example, in U.S. patent application Ser. No. 114,324 of McCullough et al, there is described blending non-flammable p-aramid fibers with the carbonaceous fibers described in U.S. patent application Ser. No. 112,353 and using a needle punch to densify the structure. However, at temperatures greater than 400 degrees C. the p-aramid decomposes and the batting looses its integrity. It is therefore a considerable advantage to be able to permanently lock a densified batting together with material which does not lose its physical properties at elevated temperatures.

U.S. Pat. No. 4,628,846 to Vives, which is incorporated herein by reference, discloses an apparatus which may be utilized to prepare the fibrous structures of the invention.

U.S. Pat. No. 4,284,680 to Awano et al discloses a multi-layered needle point felt-like cushioning material which is prepared by needle punching battings to a foundation fabric and heating to set the fibers of the batts. However, the fibers are not stabilized and heating is performed in air at temperatures wherein only a temporary set occurs.

It is understood that the term "implanting" as utilized in the present application relates to entangling, intermingling, interlocking, or the like, of the fibers.

The term "structure" as used herein generally relates to one or more plies of a mat, batting, felt or blanket. The structure may or may not be provided with one or more scrims.

SUMMARY OF THE INVENTION

The present invention is directed to a process for interlocking or implanting a fibrous structure or structures comprising a batting of non-flammable, set carbonaceous fibers with thermally stable support or binding fibers. Advantageously, the set carbonaceous fibers are non-linear and possess a reversible deflection ratio of greater than 1.2:1.

More particular, the invention relates to a process for implanting a batting structure comprising heat set polymeric carbonaceous fibers with non-heat set polymeric fibers and then heat treating the structure so as to substantially irreversibly set the implanted fibers. Advantageously, the implanted fibers are chemically similar to the precursor fibers of the batting structure. The process can be utilized to densify a fibrous structure or join together adjacent structures.

The invention further relates to the batting structures comprising non-linear fibers, which structures preferably have a bulk density of about 0.3 to about 2 lbs/ft$^3$.

The present process permits the blending of the fiber structure with large diameter fibers which have greater shear resistance in the needle punching operation.

In accordance with an embodiment of the invention, a fibrous structure of carbonaceous fibers is implanted with secondary precursor fibers that can be used to increase the mechanical strength of the structure. The implantation causes the secondary fibers to loop in the structure.

Large denier reinforcing fibers can be provided with greater mechanical strength. The heat treatment of the structure then hooks and sets the looped stitch. The heat setting of the fibers provides resistance to removal of the fiber in its locked and set position. It is important that the fibers are substantially permanently heat set and not merely heat treated to obtain the desired locking which resists slippage of fibers. A high degree of needle punching may be used to produce a felt-like structure after heat treatment.

In accordance with a further embodiment of the invention two or more battings may be joined together. The fibers of one batting can be utilized as the interlocking fibers.

DESCRIPTION OF THE PREFERRED EMBODIMENTS

Figure 1:
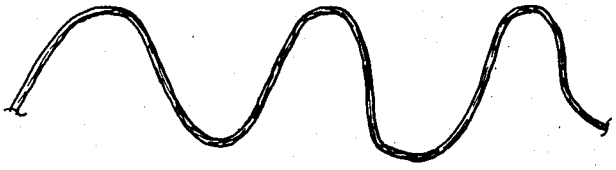
FIG. 1 is a perspective view of a filament of the invention with a sinusoidal configuration.

In accordance with the present process there is prepared a densified lightweight, non-flammable fibrous structure comprising a multiplicity of substantially permanently set carbonaceous fibers which possess both excellent thermal insulation and/or sound absorbing properties that are interlocked together with one or more other precursor fibers of similar chemical composition as the precursor fibers of the carbonaceous fibers, and wherein the interlocking other precursor fibers are substantially permanently heat set.

Preferably, the first fibers utilized in the fibrous structure of the present invention, herein referred to as "the first carbonaceous fibers", and their method of preparation are those described in U.S. patent application Ser. No. 856,305, entitled "Carbonaceous Fibers with Spring-Like Reversible Reflection and Method of Manufacture," filed 4-28-86, by McCullough et al.; incorporated herein b reference and as described in application U.S. Pat. No. 918,738, entitled "Sound and Thermal Insulation," filed, 10-14-86, by McCullough et al.; incorporated herein by reference.

In a preferred embodiment of the present invention, the fibrous structure comprises a multiplicity of resilient carbonaceous or carbon fibers having a reversible deflection of at least about 1.2:1 and an aspect ratio (1/d) greater than 10:1 interlocked with other permanently heat-set carbonaceous fibers.

The first carbonaceous fibers may be linear or possess a sinusoidal or a coil-like configuration or a more complicated structural combination of the two. These first carbonaceous fibers may also be a combination of linear and non-linear heat set fibers.

The present invention is particularly concerned with fibrous structures comprising a multiplicity of non-flammable non-linear carbonaceous or carbon filaments containing at least 65% carbon such as described in copending application Ser. No. 856,305. These filaments particularly identified by the degree of carbonization and/or their degree of electrical conductivity in the determination of the particular use for which they are most suited.

The first carbonaceous fibers or matrix fibers can be prepared by heat treating a suitable stabilized precursor material such as that derived from an assembly of stabilized polyacrylonitrile based materials or pitch base (petroleum or coal tar), polyamid or other polymeric materials which can be made into non-linear fiber or filament structures or configurations and are thermally stable.

For example, in the case of polyacrylonitrile (PAN) based fibers, fibers formed by melt or wet spinning a suitable fluid of the precursor material and having a normal nominal diameter of from about 4 to 25 micrometers, are collected as an assembly of a multiplicity of continuous filaments in tows and stabilized by oxidation (in the case of PAN based fibers) in the conventional manner. The stabilized tows (or staple yarn made from chopped or stretch broken fiber staple) are thereafter, formed into a coil-like and/or sinusoidal form by knitting the tow or yarn into a fabric or cloth (recognizing that other fabric forming and coil forming methods can be employed).

The so-formed knitted fabric or cloth is thereafter heat treated, in a relaxed and unstressed condition, at a temperature of from about 525 to about 750 degrees C., in an inert atmosphere for a period of time to produce a heat induced thermoset reaction wherein additional crosslinking and/or a cross-chain cyclization reaction occurs between the original polymer chain. At the lower temperature range of from about 150 to about 525 degrees C., the fibers are provided with a varying proportion of temporary to permanent set while in the upper range of temperatures the fibers are provided with a permanently set configuration. What is meant by "permanently set" is that the fibers possess a degree of irreversability.

Figure 2:
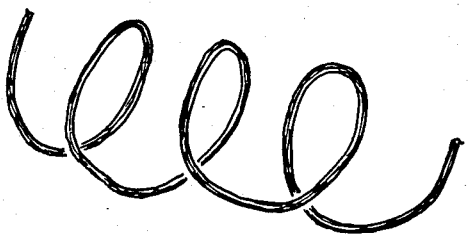
FIG. 2 is a perspective view of a filament of the invention with a coil-like configuration.

It is, of course, to be understood that the fiber or fiber assembly may be initially heat treated at the higher range of temperatures so long as the heat treatment is conducted while the coil-like and/or sinusoidal configuration is in a relaxed or unstressed state and under an inert, non-oxidizing atmosphere. As a result of the higher temperature treatment, a permanently set sinusoidal (as illustrated in FIG. 1) or coil-like (as illustrated in FIG. 2) configuration or structure is imparted to the fibers in yarns, tows or threads. The resulting fibers, tows, yarns or threads having the non-linear structural configuration which are derived by deknitting the cloth, are subjected to other methods of treatment know in the art to create an opening, a procedure in which the yarn, tow or the fibers or threads of the cloth are separated into a non-linear, entangled, wool-like fluffy material in which the individual fibers retain their coil-like or sinusoidal configuration yielding a fluff or batting-like body of considerable loft.

The stabilized non-linear fibers permanently configured into the desired structural configuration, e.g., by knitting, and thereafter heating at a temperature of greater than about 550 degrees C. retain their resilient and reversible deflection characteristics. It is to be understood that higher temperatures may be employed of up to about 1500 degrees C., but the most flexible and smallest loss of fiber breakage, when carded to produce the fluff, is found in those fibers and/or filaments are heat treated to a temperature from about 525 to 750 degrees C.

The second fibers or interlocking fibers used in the present invention include fibers capable of being interlocked with the non-linear fibers described above and which will withstand the high temperatures disclosed. The fibers may be derived from a separate thread, utilizing fibers of an adjacent batting or blended in the single layer of batting and used for densification.

Preferably, the interlocking second fibers are of the same chemical composition as the precursor fibers of the carbonaceous fibers and may be prepared from the same stabilized precursor material as the first carbonaceous fibers. For example, a suitable stabilized precursor material may comprise material such as that derived from a stabilized acrylonitrile such as polyacrylonitrile (PAN) based materials or pitch base (petroleum or coal tar) or other polymeric materials, which are thermally stable at the high temperature of interest as described above.

For example, polyacrylonitrile (PAN) based fibers can be collected as an assembly of a multiplicity of continuous filaments in tows and stabilized by oxidation in the conventional manner and the stabilized tows (or staple yarn made from chopped or stretch broken fiber staple are thereafter, in accordance with the present invention, interlocked with the above coil-like or sinusoidal fibers.

When interlocked into the fibrous structure, the second fibers may be incorporated into the structure in a linear form or non-linear form before permanently heat setting the second fibers.

Figure 3:
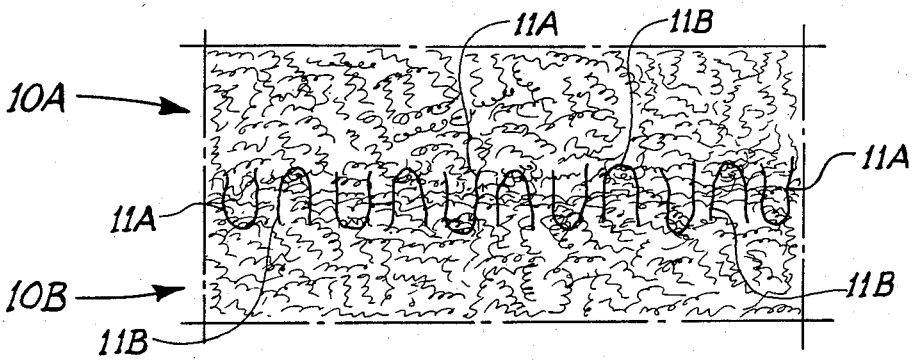
FIG. 3 is a perspective view of a pair of interlocked, non-woven fibrous structures.

As seen in FIG. 3, a carbonaceous batting 10B is covered with a non-carbonaceous batting 10A. The battings have been needle punched so that the fibers 11A from the batting 10A interlocks the two battings 10A, 10B. Optionally, fibers 11B may be carried upward so as to entangle with the fibers of batting 10A. When the two battings have been heat treated to carbonize batting 10A and its fibers 11A, the fibers 11A become lock set. Lock setting with carbonized fibers provides a stronger hold then occurring with ordinary non-carbonized fibers. The lock set fibers 11A are substantially permanently set into the configuration so that there is no slippage through the batting when pulled apart.

Figure 4:
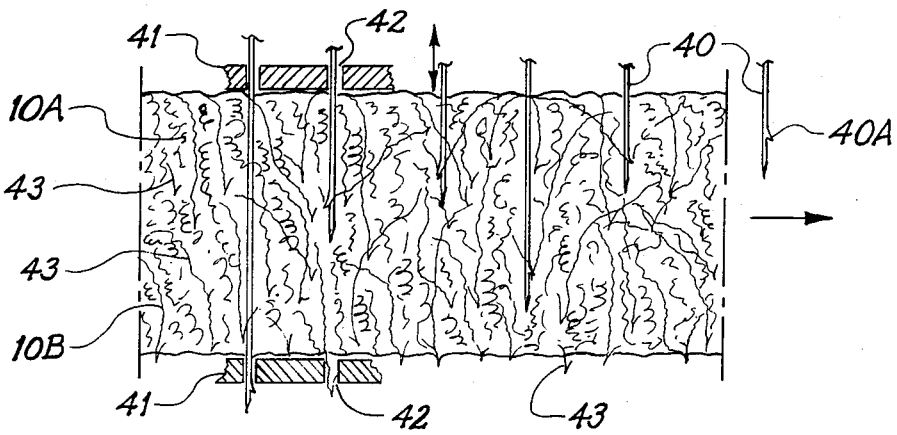
FIG. 4 illustrates a needle punch operation.

As shown in FIG. 4, there is illustrated a conventional needle punching operation with a web 10A of non-carbonaceous fibers that is laid on a web 10B of carbonaceous fibers. A needled fabric is produced by mechanically entangling the fibers. The felting needles 40 with barbs 40A entangle the fibers and form a multiplicity of locking fibers 43 throughout the web structure which densifies and interlocks the two webs 10A, 10B together. Screens 41 of the apparatus with perforations 42 are utilized to densify the webs 10A, 10B during needle punching.

After the needle punching operation, the densified web is heat treated in an inert atmosphere so as to heat set and lock the non-carbonaceous entangling fibers at the desired temperature.

Figure 4A:
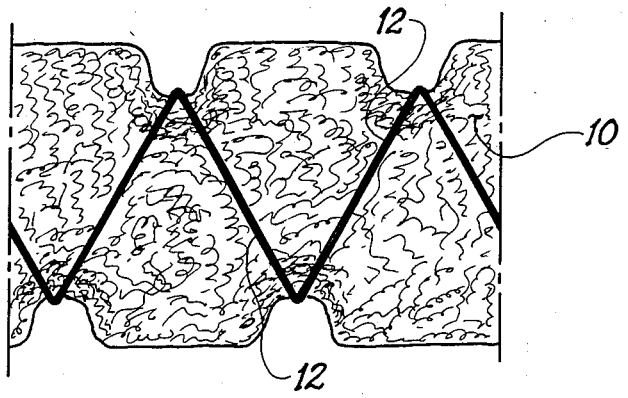
FIG. 4A is a detailed view of the structure of FIG. 4 showing a lock set secondary fiber.
Figure 6:
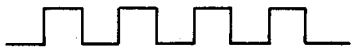
Figure 6A:
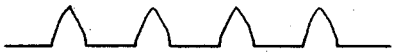

As seen in FIG. 4A, the batting 10 is needle punched with a second fiber which after heat setting or carbonization forms a V-shaped set structure. However, the needle punching pattern may be any one which may be performed by adjusting the apparatus. Other suitable patterns are shown in FIGS. 6 and 6A.

The second fibers may be first provided with a varying proportion of temporary to permanent set by heating at a temperature range of about 150° to 525° C. The fibers are then permanently set by chemically treating or heat treating the structure after the interlocking step. Preferably, the second heat treatment is at an upper range of temperatures of from about 525 degrees C. and above such that the fibers are provided with a permanent shape set.

When the second fibers are permanently heat set, integrity and handleability is imparted to the structure comprising the combination of the first carbonaceous fibers and second carbonaceous fibers.

As with the first fibers, temperatures of up to about 1500 degrees C. may be employed, but the most flexible and smallest loss of fiber breakage, is found in those fibers and/or filaments heat treated to a temperature from about 425 and 750 degrees C.

Figure 5:
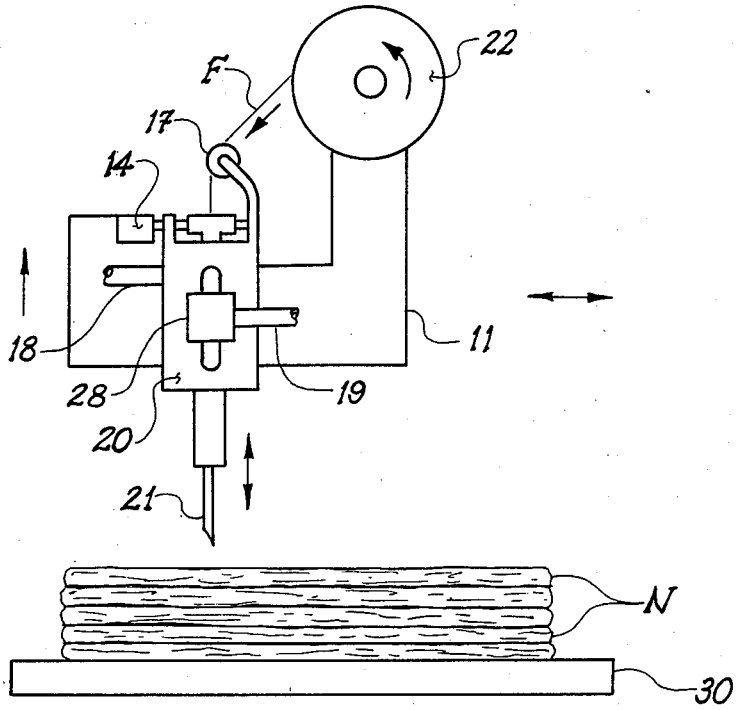
FIG. 5 is a diagrammatical view of a device for producing the interlocked battings of the invention; and, FIGS. 6 and 6A illustrate stitch patterns that the implanted fiber may form.

As shown in FIG. 5, an apparatus as disclosed in U.S. Pat. No. 4,628,846 may be utilized for the production of the structure of the invention from layers of different materials.

The layers N are bound together, as they are stacked, by means of binding threads taken from a continuous thread F and threaded in the structure in such a way as to go through the last layer deposited and at least part of the subjacent layer.

Thread F is in supple and strong material, such as for example a larger denier oxidized polyacrylonitrile fibers.

The binding threads are inserted in the layers of the structure by means of an injection head 20 equipped with a hollow tubular needle 21. Said head 20 is mounted on a carriage 11 movable with respect to the platen 30 and receives the thread F from a storage reel 22 which is also carried by the carriage.

The tubular needle 21 may be moved with respect to the head 20 with a rectilinear back and forth movement, parallel to its axis.

The thread F is drawn from the reel 22 by a pair of press-rollers 15, 16 between which the thread is gripped. Said rollers are mounted on the back of the head 20, outside thereof and are set in rotation by way of an electric motor 14 in engagement with the axle of one of the rollers. The thread F, having passed over a return roller 17 penetrates into the injection head through an opening provided in the back wall of the head body. Along its substantially straight path inside the head 20, the thread F is guided through a duct which is extended at the front by longitudinal ducts provided inside the device and inside the needle 21.

Duct may be supplied with pressurized fluid through a hole provided in the head body and connected via a pipe to a source of pressurized fluid (such as compressed air or water under pressure, for example). With the exception of its front part, the duct is tightly sealed so that the fluid admitted therethrough can escape only through the needle 21.

The device described hereinabove works as follows.

At the beginning of the positioning cycle of the binding thread through a newly deposited layer N', the injection head 20 is placed above said layer with the end of the needle 21 situated a few millimeters from the surface of the layer. The rollers 15, 16 are immobilized and the duct is fed with pressurized fluid driving the thread F, one end of which thread is slightly offset from the outlet orifice of the needle 21.

As shown, needle 21 is directed perpendicularly to the platen 30 and therefore penetrates normally into the layers. The press-rollers 15, 16 are driven in rotation during the descending movement of the needle so that the thread descends at the same speed as the needle without slipping out of it. The length of the stroke of the needle is so selected that said needle goes through at least the layer N' and a substantial part of the subjacent layer. Understandably, the needle could penetrate through more than two layers, especially if these are relatively thin. The pressurized fluid released through the end of the needle tends to move the fibers of the structure away during the penetration of the needle, thus preventing any damaging of the fibers. The principal function of the pressurized liquid is to push the thread in order to keep it stretched inside the injection head and to ensure its penetration into the structure over the same length as the needle.

When the needle has reached the end of its downstroke, the chamber **25*a* is put into communication with the atmosphere, whereas pressurized fluid is admitted into chamber 25*b*. The needle is raised up, rollers 15, 16** being immobilized. The segment of thread inserted into the structure stays in.

The carriage 11 is moved one step in parallel to the tray 10 and the needle is lowered in again simultaneously with the forward movement of the thread F. The segment of thread of the preceding perforation stretches and breaks at the level of the end of the needle when the latter penetrates into layer N', said segment being thus separated from the thread F inside the structure.

The needle, having reached the end of its stroke, is raised up again, leaving in place another segment of thread.

The process is thus repeated over a line starting from one edge of the stack of layers to the opposite edge. The carriage carrying the head is then moved one step in a direction perpendicular to said line with a view of inserting a new series of binding threads along another line. When the perforations and insertions of binding threads are completed throughout the layer N', another layer is deposited while the carriage carrying the injection head is raised over the platen 10 of a height equal to the thickness of the layer. The displacement of the carriage in two orthogonal directions (X and Y) parallel to the surface of the layer and in a third direction perpendicular to said surface is achieved by means of stepwise motors (not shown).

In the case considered hereinabove, each inserted segment of binding thread has a first portion implanted in the structure. After the withdrawal of the needle, a second portion over the surface after a one-step displacement of the head, and a third portion carried with the needle in the next perforation with breaking of the thread at the level of the end of the needle, said third portion adjoining the next segment of thread deposited.

The interlocked carbonaceous fibrous material which forms the batting and/or the implanted heat treated fiber which forms the interlock may be classified into three groups depending upon the particular use and the environment that the structures in which they are incorporated are placed.

In a first group, the carbonaceous fibers used in the structure of the present invention are non-flammable and non-electrically conductive.

The term non-conductive as utilized in the present application relates to an electrical resistance of greater than $10^7$ ohms per inch when measured on a 6 K tow formed from fibers having a diameter of 4 to 12 microns (specific resistivity greater than about $10^2$ ohms cm).

In a second group, the non-flammable non-linear carbonaceous fibers used in the structure of the present invention are classified as being partially electrically conductive (i.e., having low conductivity) and have a carbon content of less than 85%. When the precursor stabilized fiber is an acrylic fiber, i.e., a polyacrylonitrile based fiber, the percentage nitrogen content is from about 5 to 35%, preferably, from about 16 to 20%. These particular fibers are excellent for use as insulation for aerospace vehicles as well as insulation in areas where public safety is a concern. The structures formed therefrom are lightweight, have low moisture absorbancy, good abrasive strength together with good appearance and handle.

The larger the amount of carbon content of the fibers utilized, the higher the degree of electrical conductivity. These high carbon non-linear filaments still retain a wool-like appearance in the batting especially when the majority of the fibers are coil-like. Also, the greater the percentage of coil-like fibers in the structure, the greater is the resiliency of the structure. As a result of the greater carbon content, the structures prepared with these filaments have greater sound absorbing properties and result in a more effective thermal barrier at higher temperatures. Low conductivity means that a 6 K tow of fibers formed from fibers having a diameter of 4 to 12 microns has a resistance of about $10^7$–$10^4$ ohms per inch.

In a third group are the carbonaceous fibers used in the structure of the present invention having a carbon content of at least 85%. These fibers, as a result of their high carbon content, have superior thermal insulating and sound absorbing characteristics. The coil-like fibers in the form of a fluff provides a structure which has good compressibility and resiliency while maintaining improved thermal insulating efficiency. The structure prepared with the third group of fibers has particular utility in the insulation of furnaces and in areas of high heat and noise.

Preferably, the fibers of the third group which are utilized are derived from stabilized acrylic fibers and have a nitrogen content of less than 10%. As a result of the still higher carbon content, the structures prepared are more electrically conductive. That is, the resistance is less than $10^4$ ohms per inch when measured on a 6 K tow of fibers formed from precursor fibers having a diameter of 4 to 12 microns.

The precursor stabilized acrylic filaments which are advantageously utilized in preparing the fibers of the structures are selected from the group consisting of acrylonitrile homopolymers, acrylonitrile copolymers and acrylonitrile terpolymers. The copolymers preferably contain at least about 85 mole percent of acrylonitrile units and up to 15 mole percent of one or more monovinyl units copolymerized with styrene, methylacrylate, methyl methacrylate, vinyl chloride, vinylidene chloride, vinyl pyridine, and the like. Also, the acrylic filaments may comprise terpolymers, preferably, wherein the acrylonitrile units are at least about 85 mole percent.

It is to be further understood that carbonaceous precursor starting materials may have imparted to them an electrically conductive property on the order of that of metallic conductors by heating the fiber fluff or the batting like shaped material to elevated temperatures in a non-oxidizing atmosphere. The electroconductive property may be obtained from selected starting materials such as pitch (petroleum or coal tar), polyacetylene, acrylonitrile based materials, e.g., a polyacrylonitrile copolymer (PANOX or GRAFIL-01), polyphenylene, polyvinylidene chloride (SARAN, trademark of The Dow Chemical Company), polyamid (KEVLAR, a trademark of Dupont) and the like.

In accordance with a feature of the invention antistatic filaments can be inserted into the structure which also services as the interlocking and densifying fibers.

Preferred precursor materials are prepared by melt spinning or wet spinning the precursor materials in a known manner to yield a monofilament fiber tow. The fibers or filaments, yarn, tow, woven cloth or fabric or knitted cloth may be formed by any of a number of commercially available techniques such as disclosed in said application Ser. No. 856,305. These precursor materials preferably have a Limited Oxygen Index (LOI) greater than 40.

If desired, the densified structures can be heat treated to form carbon or graphite structures. The present process permits the preparation of carbon or graphite structures without complicated knitting operations.

It is understood that all percentages as herein utilized are based on weight percent.

Exemplary of the present invention is set forth in the following examples:

EXAMPLE 1

A. A non-linear carbonaceous fiber which had been heat treated to 550 degrees C. and opened on a Shirley was blended with 25% by weight Dogbone shaped larger denier OPF (oxidized PAN fiber) obtained from RK Carbon Fibers, Inc. of Philadelphia, Pa. The Dogbone OPF had a temporary crimp set in at 200 degrees C. prior to blending. Battings were combined and run through a needle punch machine and densified from 3 inches thick to about ¾ inch thick with the same precursor fibers.

B. The resulting densified batting or felt from Part A which contained the Dogbone OPF lock stitches was heat treated at 700 degrees C. under a nitrogen atmosphere for 60 minutes. The resulting felt had good permanent integrity and was stable to a temperature greater than 400 degrees C.

EXAMPLE 2

Following the procedure of Example 1A, a densified batting was formed. The resulting batting was then heat treated at a temperature of 1500 degrees C. for 60 minutes to produce a uniform carbon structure which was suitable as sound and thermal insulation.

What is claimed is:

1. A densified batting structure comprising a batting of linear and non-linear first carbonaceous fibers having an LOI value greater than 40, a reversible deflection ratio greater than 1.2:1 and an aspect ratio greater than 10:1 and a substantially permanently heat set non-flammable second carbonaceous fiber densifying said batting and locking said batting into a densified structure.

2. The structure of claim 1 wherein said second carbonaceous fiber has a higher denier than said first carbonaceous fibers.

3. The structure of claim 1 wherein said first and second carbonaceous fibers have a nitrogen content of about 16 to 20%.

4. The structure of claim 1 wherein said second carbonaceous fibers are different from said first carbonaceous fibers.

5. A densified batting structure comprising a batting of non-linear first carbonaceous fibers having a reversible deflection ratio greater than 1.2:1 and an aspect ratio greater than 10:1 and a heat set second carbonaceous fiber densifying said batting and locking said batting into a densified structure.

* * * * *